US005953948A

United States Patent [19]

Isozaki

[11] Patent Number: 5,953,948

[45] Date of Patent: Sep. 21, 1999

[54] WIRE ROLLING APPARATUS

[75] Inventor: Iwao Isozaki, Mobara, Japan

[73] Assignee: Plant Engineering Yoshida Kinen Co., Ltd., Mobara, Japan

[21] Appl. No.: 09/132,169

[22] Filed: Aug. 11, 1998

[30] Foreign Application Priority Data

Sep. 19, 1997 [JP] Japan ..... 9-273556

[51] Int. Cl.[6] ..... B21B 13/12; B21B 35/00

[52] U.S. Cl. ..... 72/224; 72/249; 72/226

[58] Field of Search ..... 72/224, 225, 226, 72/234, 235, 237, 249, 241.2, 241.4, 242.2, 242.4, 243.2, 243.4; 148/641, 643

[56] References Cited

U.S. PATENT DOCUMENTS 2,214,279 9/1940 Kocks ..... 72/224

*Primary Examiner*—Rodney Butler
*Attorney, Agent, or Firm*—Jones, Day, Reavis & Pogue

[57] ABSTRACT

In a wire rolling apparatus, a pair of first wall portions of a roll housing support the rotating shaft of a backup roll, and a second wall portion connects the pair of first wall portions to each other. Even if a large force is applied to the rotating shaft of the backup roll not only perpendicular to the wire feed direction but also opposite to it, the pair of first wall portions do not distort easily. Accordingly, the degree of abutment of the backup roll against the outer circumferential surface of the work roll is not easily altered, and a stable desired pressure can be obtained, so that a wire can be rolled with high precision.

3 Claims, 8 Drawing Sheets

WIRE ROLLING APPARATUS

BACKGROUND OF THE INVENTION

1. Field of the Invention

The present invention relates to a rolling apparatus for forming a wire made of a metal, a plastic, a ceramic material or the like to a desired sectional shape by using a plurality of pressure rolls.

2. Description of the Related Art

In Japanese Patent Publication No. 6-73687, the present inventor disclosed a wire rolling apparatus comprising a plurality of work rolls having grooves in their outer circumferential surfaces. A wire is inserted in a space formed by abutting the outer circumferential surfaces of the plurality of grooved work rolls against each other and aligning the grooves of the plurality of grooved work rolls with each other, and is rolled by driving the plurality of grooved work rolls. In this apparatus, the plurality of grooved work rolls serve as driven rolls. Backup rolls arranged almost diametrically opposite to the wire insertion space with respect to the grooved work rolls are pressed against the grooved work rolls, thereby transmitting the drive force. The center of each grooved work roll is offset from the center of the respective backup roll in a wire feed direction.

FIG. 1 is a perspective view showing an example of the rolling apparatus of the above publication. A frame 102 is mounted on the upper part of the front face of a rolling apparatus 100 shown in FIG. 1. In the frame 102, U-shaped open-ended portions are set to face each other from three directions, so that the frame 102 has an inverted Y-letter shape. A means for holding grooved work rolls is built on the central portion of the front surface of the frame 102. This means includes a knob 103 for adjusting the offset of the grooved work rolls. Backup rolls 101 are accommodated in an opening 104 of the frame 102 with movable blocks 105.

The grooved work rolls, although not shown in FIG. 1 as they are located at positions concealed by the means for holding them, abut against the backup rolls 101 within the opening 104. A wedge 106 is disposed between one side surface 104*a* of the opening 104 and one end face 105*a* of each movable block 105. The wedge 106 moves the corresponding movable block 105 to press the corresponding backup roll 101 against the corresponding grooved roll. A bolt 106*a* is mounted on the end portion of the wedge 106. When the bolt 106*a* is fastened, the wedge 106 enters the opening 104 to press against one end face 105*a* of the movable block 105, thereby moving the movable block 105.

To roll the wire with the rolling apparatus 100, first, the knob 103 is operated to adjust the offset of the grooved work rolls, and the positions of the wedges 106 are adjusted to move the movable blocks 105. This determines the magnitudes of the pressures of the backup rolls 101 against the grooved work rolls. The magnitudes of the pressures of the backup rolls 101 against the grooved work rolls must be adjusted to predetermined values in each backup roll 101. When the backup rolls 101 and the grooved work rolls are equidistantly, radially arranged as shown in FIG. 1, the pressures of the backup rolls 101 must be set equal to each other.

In the rolling apparatus 100 of the above publication, a force according to the pressure of the backup roll 101 against the grooved work roll acts on one side surface 104*a* of the opening 104. If the pressure is increased, a distortion tends to occur in this one side surface 104*a* and a wall portion around the opening 104. The position of the movable block 105 is thus shifted and the degree of abutment of the backup roll 101 against the outer circumferential surface of the grooved work roll changes. As a result, it is difficult to obtain a stable desired pressure and to roll the wire with high precision.

Since the pressures of the backup rolls 101 against the respective grooved work rolls are set to predetermined values by adjusting the positions of the respective movable blocks 105, it takes time to set the pressures of the backup rolls 101 against the respective grooved work rolls. Accordingly, it is difficult to roll the wire at a high throughput.

SUMMARY OF THE INVENTION

In a wire rolling apparatus according to the invention, a pair of first wall portions of a roll housing support the rotating shaft of a backup roll, and the second wall portion arranged in at least one of the wire feed direction and the direction opposite to it connects the pair of first wall portions to each other. Even if the rotation center of the work roll is offset from the rotation center of the backup roll in the wire feed direction, and the pressure of the backup roll against the work roll is large, so that a large force is applied to the rotating shaft of the backup roll not only in a direction perpendicular to the feed direction but also in the feed direction or the direction opposite to it, the first wall portions that support the rotating shaft of the backup roll are not easily distorted. Accordingly, the degree of abutment of the backup roll against the outer circumferential surface of the work roll does not change easily, and a stable desired pressure can be obtained, so that the wire can be rolled with high precision.

In a preferred wire rolling apparatus according to the invention, a roll holder which holds the plurality of work rolls is movable in the wire feed direction and in the direction opposite to it. Offset between the rotation center of the backup roll and the rotation center of the work roll in the wire feed direction can be adjusted by moving only the roll holder, and the pressures of the plurality of backup rolls against the plurality of work rolls can accordingly be adjusted simultaneously. The pressures can be adjusted within a short period of time, so that the wire can be rolled at a high throughput.

In a further preferred wire rolling apparatus according to the invention, the position of the backup roll can be adjusted in the direction of the rotating shaft, so that the backup roll can be precisely positioned with respect to the outer circumferential surface of the work roll. In addition, variations in position of the backup roll with respect to the outer circumferential surface of the work roll can be suppressed by applying a pre-load to the rotating shaft of the backup roll. Therefore, the backup roll can be accurately pressed against the outer circumferential surface of the work roll, and the drive force can be reliably transmitted from the backup roll to the work roll. As a result, the drive force has a small loss and the wire can be rolled at a low cost.

In a yet further preferred wire rolling apparatus according to the invention, a roll housing is constituted by a pair of frames arranged in the wire feed direction. Since the backup rolls are arranged within a plane perpendicular to the wire feed direction, all the backup rolls can be exposed by removing only one of the pair of frames constituting the roll housing from the other frame. Hence, inspection, maintenance, exchange and the like of the backup rolls can be performed within a short period of time, and the wire can be rolled at a high throughput.

DETAILED DESCRIPTION OF THE PREFERRED EMBODIMENTS

Figure 1:
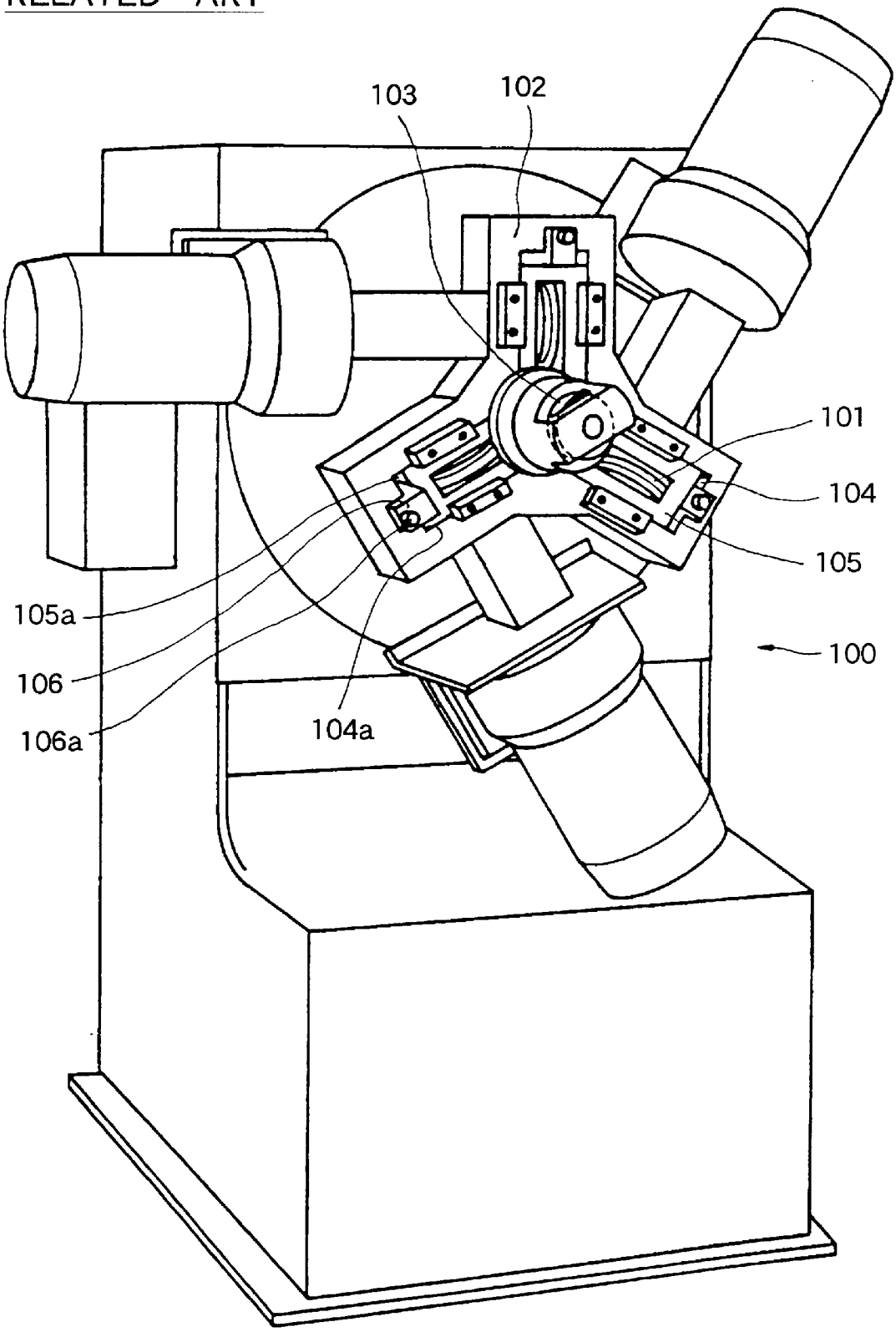
FIG.1 RELATED ART
FIG. 1 is a perspective view of a conventional rolling apparatus.
Figure 2:
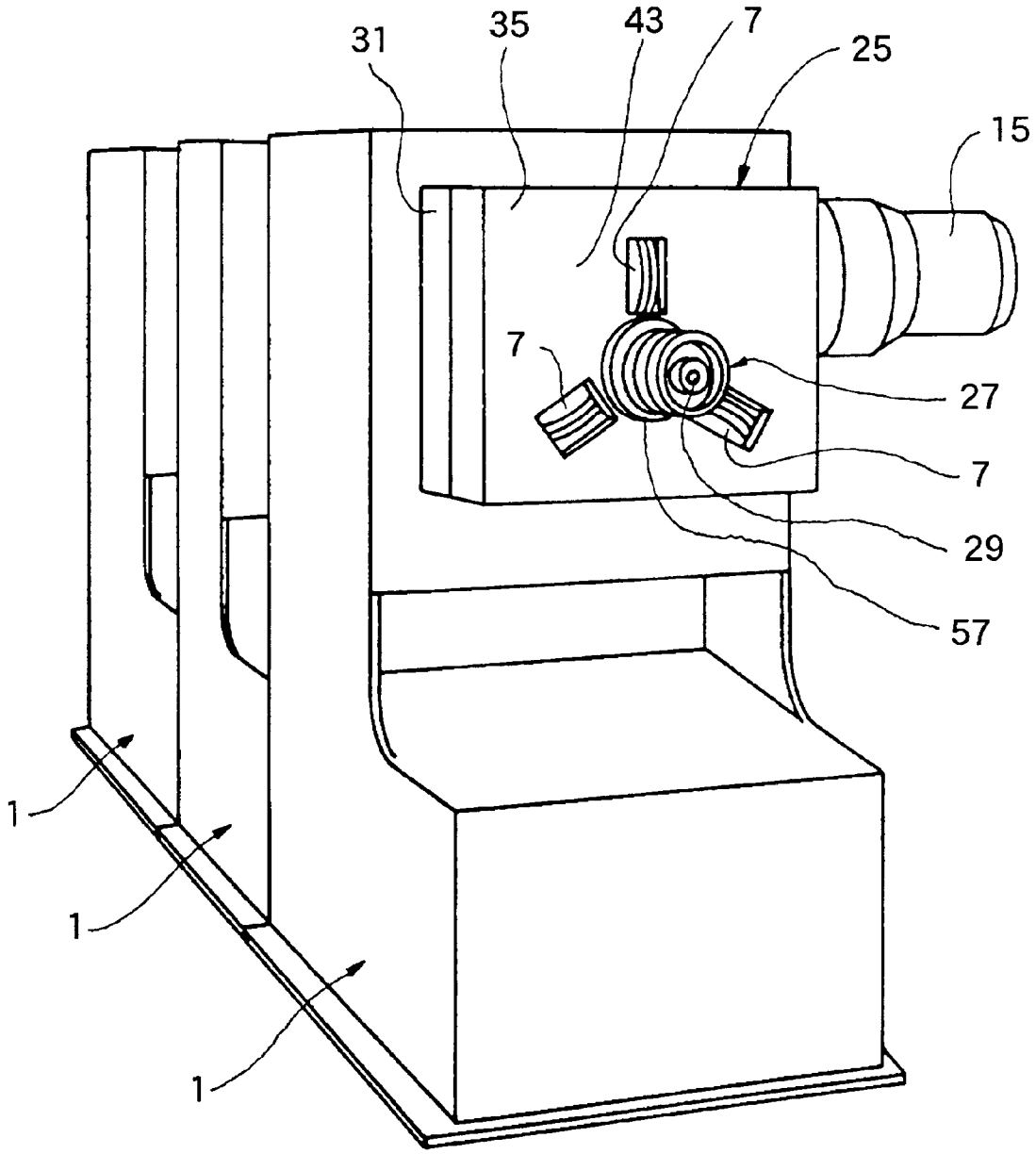
FIG. 2 is a perspective view showing an example of how a rolling apparatus according to the first embodiment may be deployed.

FIG. 2 is a perspective view showing the outer appearance of a rolling apparatus 1 according to the first embodiment and an example of how it may be deployed. A substantially box-like roll housing 25 is fixed to the upper part of the front face of the rolling apparatus 1 with bolts (not shown). The roll housing 25 accommodates backup rolls 7 and work rolls 5 (FIG. 3), and a motor 15 for driving the backup rolls 7 is mounted on the roll housing 25. A roll holder 27 for holding the work rolls 5 is fixed to substantially the center of a front surface 43 of the roll housing 25 with bolts (not shown) through a flange portion 57.

The roll housing 25 is constituted by a rear housing 31 mounted on the upper part of the front face of the rolling apparatus 1, and a front housing 35 combined with the rear housing 31. The rear housing 31 and the front housing 35 are connected to each other with bolts (not shown) inserted from the front housing 35 side. In FIG. 2, the various types of bolts that connect the respective portions are omitted.

This rolling apparatus 1 rolls a wire (not shown) while feeding it from its rear face to its front face through a central hole 29 of the roll holder 27. FIG. 2 shows an arrangement in which three rolling apparatuses 1 are arranged in series to roll the wire while sequentially feeding it from the far rolling apparatus 1 to the near rolling apparatus 1. The number of rolling apparatuses 1 used in this case is related to the material of the wires to be rolled and the rolling ability of the rolling apparatuses 1, and is increased or decreased as required. The time required for rolling the wire tends to increase in proportion to the number of rolling apparatuses 1.

Figure 3:
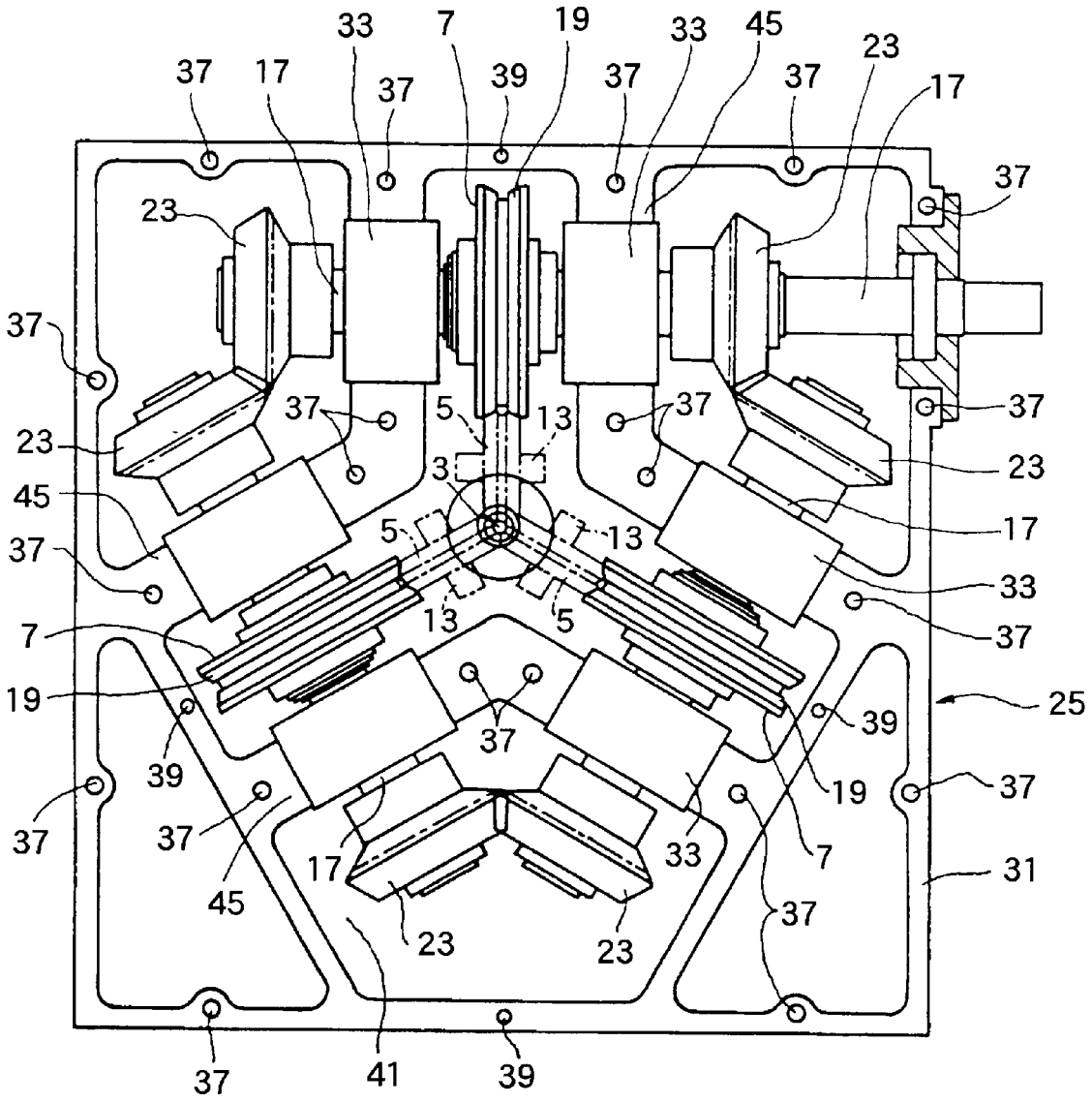
FIG. 3 is a front view showing backup rolls installed in the rear housing of the roll housing shown in FIG. 2.

FIG. 3 is a front view of the rear housing 31 obtained by removing the front housing 35 from the roll housing 25 shown in FIG. 2. The three backup rolls 7 are arranged in the rear housing 31 equidistantly from a wire 3 to be rolled and radially about the wire 3 as the center at an angular spacing of 120°, and each backup roll 7 is sandwiched by a pair of wall portions 45. Each pair of wall portions 45 is arranged on a support member 41 of the rear housing 31. In this embodiment, a wall of the rear housing 31 at the side which is mounted on the upper part of the front face of the rolling apparatus 1 is utilized as the support member 41. Each pair of wall portions 45 has bearing mechanisms 33 for supporting a shaft 17 of the corresponding backup roll 7. The respective backup rolls 7, the respective shafts 17 and the respective bearing mechanisms 33 have strengths sufficient for enduring rolling of the wire 3.

The front housing 35 is installed on the rear housing 31, with the three work rolls 5 arranged between the respective backup rolls 7 and the wire 3, as indicated by imaginary lines. One portion of the outer circumferential surface of each of these work rolls 5 comes into contact with the outer circumferential surface of the corresponding backup roll 7, and the substantially diametrically opposite portion thereof abuts against the corresponding portion of each other work roll 5, thereby forming a gap for rolling the wire 3. The rear housing 31 is provided with a plurality of female thread portions 37 for engaging with bolts securing the front housing 35 (FIG. 2) thereto, and with a plurality of positioning pins 39.

In this embodiment, the diameter of each work roll 5 is substantially half that of the backup roll 7. The shafts 13 of the work rolls 5 and bearings are made small so that the small-diameter work rolls 5 can be arranged in a region inside the backup rolls 7.

When the diameter of the work rolls 5 is decreased, the contact area of the work rolls 5 with the wire 3 decreases, and the rolling force per unit area is increased, thereby increasing the rolling efficiency of the wire 3. A decrease in diameter of the work rolls 5 contributes to downsizing of the roll housing 25 as well. Since one portion of each work roll 5 abuts against the corresponding portion of each other work roll 5 while the diametrically opposite portion thereof is pressed by the corresponding backup roll 7, not a very large load acts on the shaft 13 of each work roll 5 and the bearings.

A pair of gears 23 are connected with nuts to each shaft 17, and each gear 23 meshes with an adjacent gear 23 on an adjacent shaft 17. One of the shafts 17 projects through a side portion of the rear housing 31 to the outside to serve as the input shaft of the drive from the motor 15. Accordingly, the three backup rolls 7 are synchronously driven by one motor 15.

Figure 4:
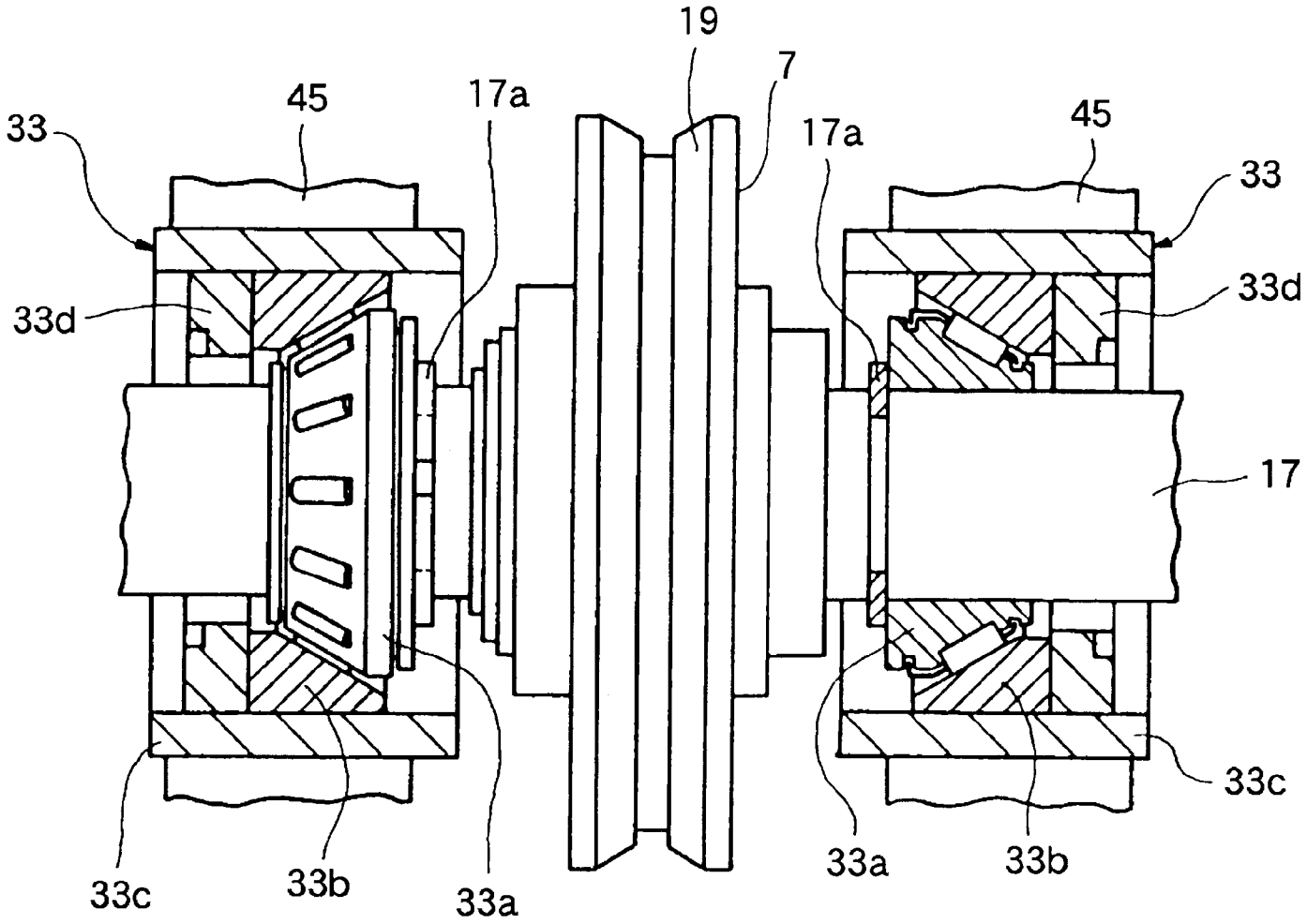
FIG. 4 is a view of the bearing mechanisms of the rotation shaft of a backup roll with parts in section.

FIG. 4 shows in section a pair of the bearing mechanisms 33 shown in FIG. 3. Each bearing mechanism 33 uses a known tapered roller bearing 33*a* and an outer race 33*b* combined with the tapered roller bearing 33*a*. The tapered roller bearing 33*a* is mounted on the shaft 17 and is positioned abutting against a stop clip 17*a* located in a groove in the shaft 17. The outer race 33*b* is fitted in a guide cylinder 33*c* mounted on the wall portion 45 of the rear housing 31, and is movable in the axial direction.

A ring nut 33*d* is screwed into the guide cylinder 33*c*. The outer race 33*b* can be pressed in the axial direction by screwing the ring nut 33*d* further into the cylinder 33*c*. Accordingly, when the pair of ring nuts 33*d* are screwed toward each other, they can pre-load the pair of tapered roller bearings 33*a*, thereby preventing backlash of the backup roll 7. When one ring nut 33*d* is loosened while the other ring nut 33*d* is screwed in, the backup roll 7 moves in the axial direction.

Figure 5:
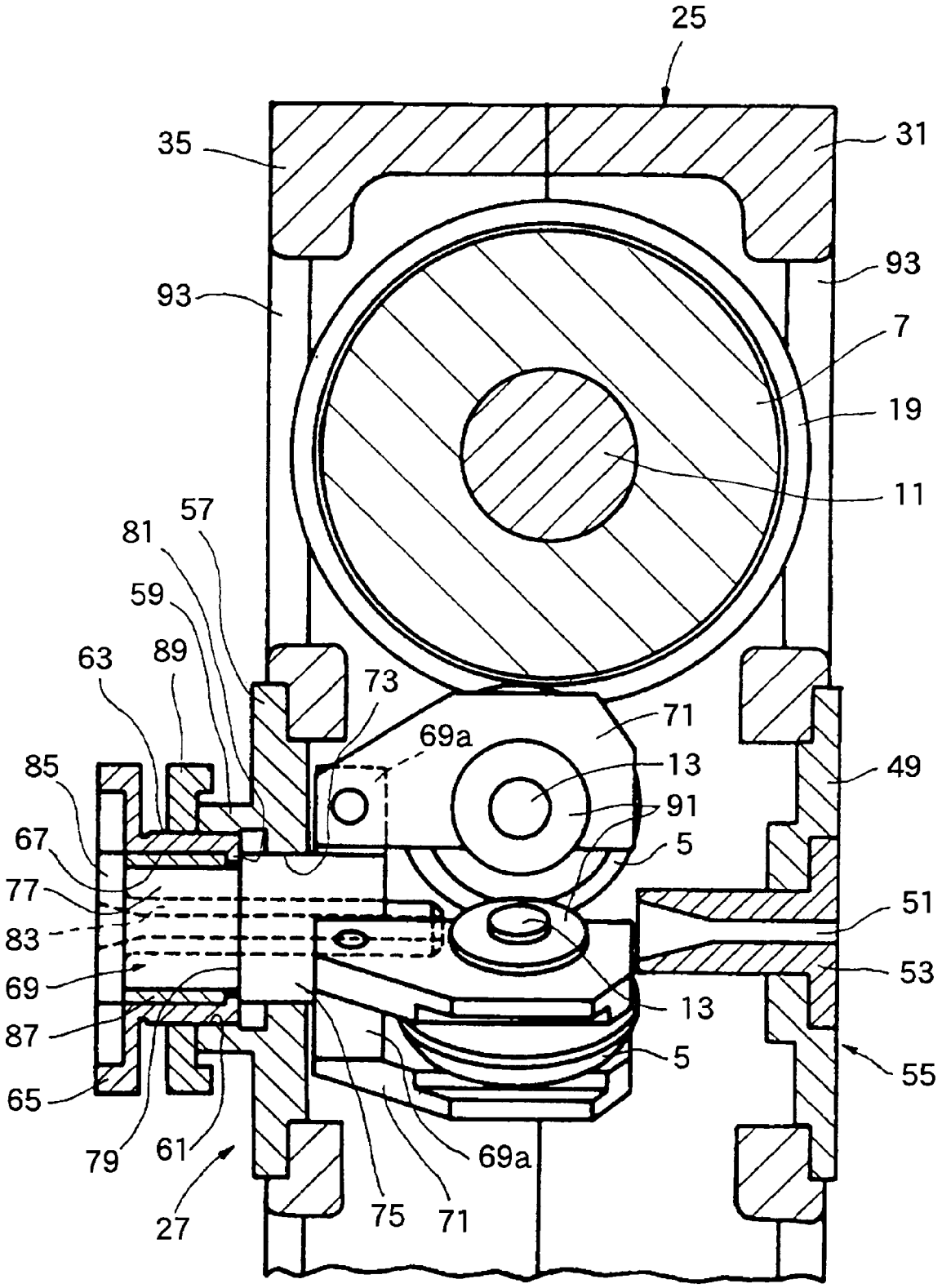
FIG. 5 is a longitudinal sectional view showing part of the roll housing.

FIG. 5 is a longitudinal sectional view of part of the roll housing 25 and shows one backup roll 7, the roll holder 27, and two of the work rolls 5 held by the roll holder 27. A center piece 53, in which a through hole 51 corresponding to the thickness of the wire is formed, is mounted on the rear housing 31 by a flange member 49 to serve as a wire introducing portion 55.

The roll holder 27 is mounted at a position on the front housing 35 that opposes the wire introducing portion 55 of the rear housing 31. In the roll holder 27, a mechanism for holding the three work rolls 5 at the predetermined positions and an arrangement necessary for guiding the rolled wire outside the roll housing 25 are built as one assembly by using a flange portion 57, fixed to the front housing 35 with bolts (not shown), as the base.

A guide hole 73 and a cylindrical portion 59 are concentrically arranged in the flange portion 57. The guide hole 73 guides a large-diameter portion 75 of a cylindrical center holder 69 in which the large-diameter portion 75 and a small-diameter portion 77 are formed as one piece. The cylindrical portion 59 has a female thread 61 that engages a male thread 63 of an adjusting knob 65 that adjusts the axial position of the center holder 69.

Three brackets 69*a* are arranged at the free end of the large-diameter portion 75 of the center holder 69 at an angular spacing of 120°. Link members 71 for supporting the corresponding work rolls 5, such that the outer circumferential surfaces of the work rolls 5 abut against each other, are swingably held by the brackets 69*a*.

A through hole 67 through which the small-diameter portion 77 of the center holder 69 is inserted is formed in the adjusting knob 65. A projection 81 is formed on an inner surface of the through hole 67 to abut against a step 79 between the large-diameter portion 75 and small-diameter portion 77 of the center holder 69. A cylindrical spacer 87 is inserted between the small-diameter portion 77 of the center holder 69 and the through hole 67. One end of the spacer 87 opposes the step 79 to sandwich the projection 81 with the step 79. The other end of the spacer 87 comes into contact with a flange portion 85 of a center piece 83 inserted in the center of the center holder 69.

Accordingly, when the adjusting knob 65 is tightened, the projection 81 pushes the step 79 to decrease the offset between a center 11 of the backup roll 7 and the center of the work roll 5 in the wire feed direction. When the adjusting knob 65 is loosened, the projection 81 pushes one end of the spacer 87 to increase the offset between the center 11 of the backup roll 7 and the center of the work roll 5 in the wire feed direction.

The smaller the offset between the center 11 of the backup roll 7 and the center of the work roll 5 in the wire feed direction, the higher the wire rolling force. Upon receiving the rotation force of the corresponding backup roll 7, each work roll 5 is biased in the rotating direction of the backup roll 7. Accordingly, if the offset is set to 0 at first,the offset will not remain at 0, and the rolling force is decreased by the biasing.

A stop ring 89 is screwed onto the male thread 63 of the adjusting knob 65 so that the adjusting knob 65 will not rotate after the offset is adjusted. The stop ring 89 abuts against the free end of the cylindrical portion 59 to prevent rotation of the adjusting knob 65. Of the front housing 35 and the rear housing 31, portions that face the backup roll 7 form openings 93. This decreases the weight of the roll housing 25 and allows inspection of the backup roll 7.

Figure 6:
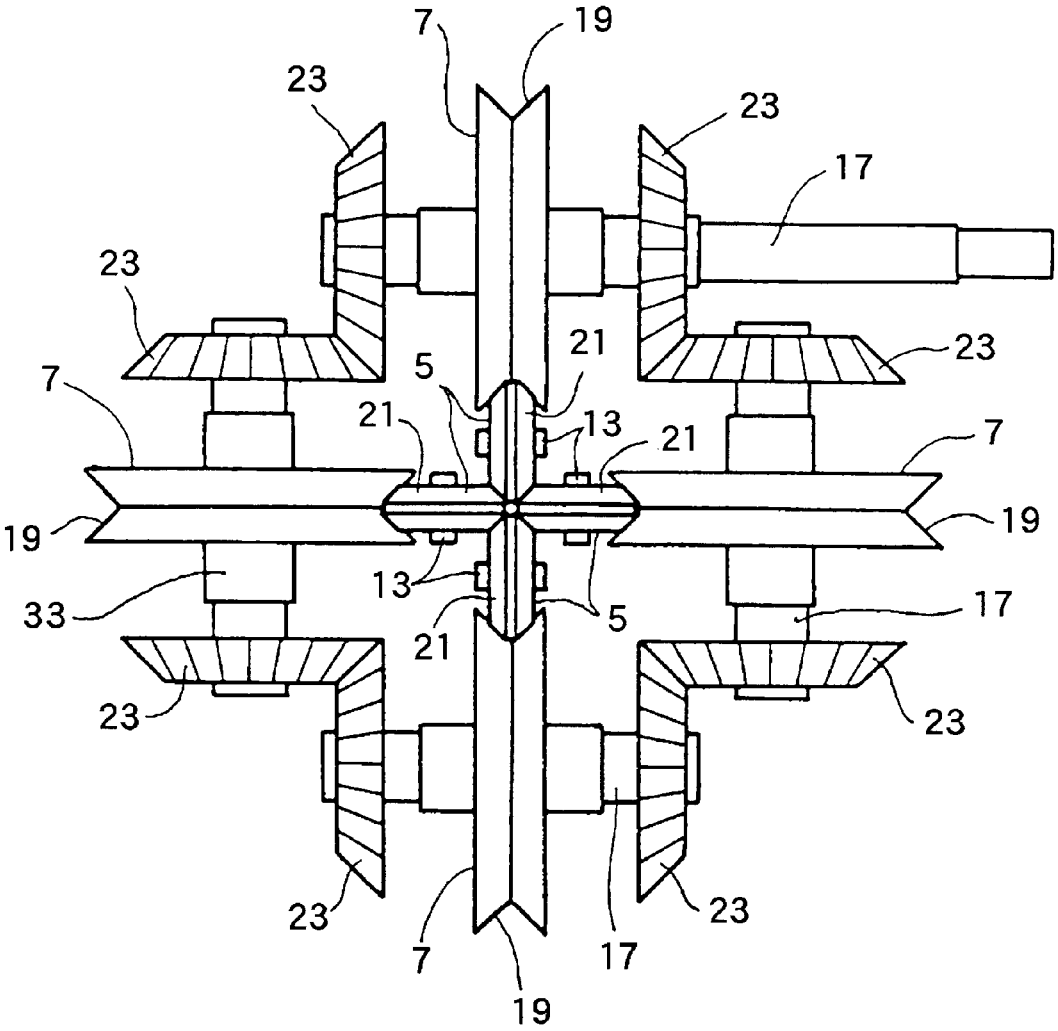
FIG. 6 is a front view schematically showing the main part of a rolling apparatus according to the second embodiment, in which a wire is rolled from four directions.

FIG. 6 is a front view schematically showing the arrangement of the respective rolls of a rolling apparatus according to the second embodiment, in which a wire is rolled from four directions. Both work rolls 5 and backup rolls 7 are arranged at an angular spacing of 90°. Accordingly, the angles of the V-shaped grooves 19 of the backup rolls 7, the tapered surfaces 21 of the work rolls 5 and the angles of the gear surfaces of gears 23 are different from those of the first embodiment.

Figure 7:
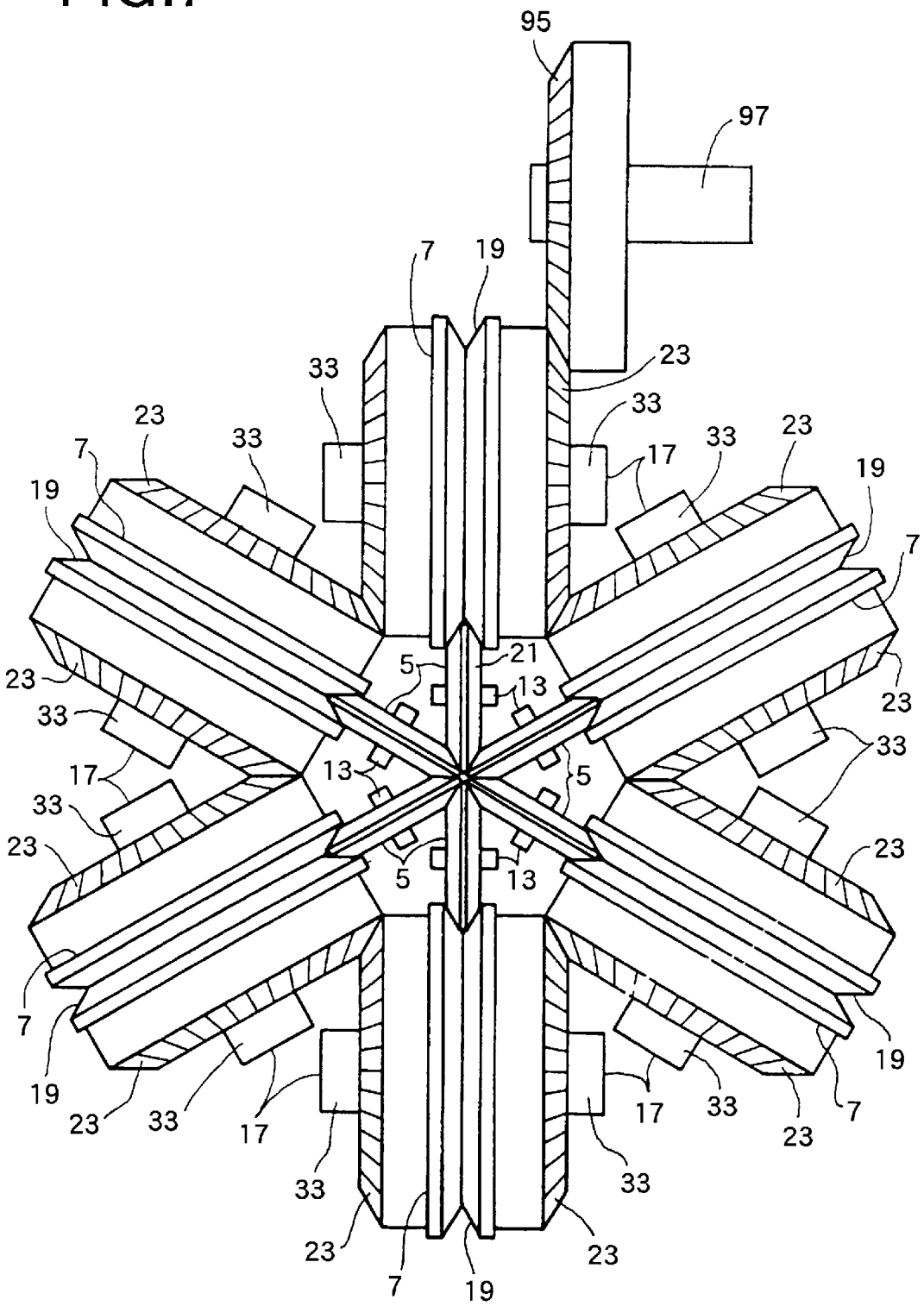
FIG. 7 is a front view schematically showing the main part of a rolling apparatus according to the third embodiment, in which a wire is rolled from six directions.

FIG. 7 is a front view schematically showing the arrangement of the respective rolls of rolling apparatus according to the third embodiment, in which a wire is rolled from six directions. In the third embodiment, the angle formed by respective shafts 17 of adjacent backup rolls 7 exceeds 90°, and a space for arranging gears 23 cannot be ensured at the end portions of the shafts 17. Hence, the gears 23 are arranged near the two side surfaces of each backup roll 7, and bearing mechanisms 33 are arranged on the two ends of each shaft 17. Since one of the shafts 17 of the backup rolls 7 cannot be extended to serve as the input shaft, an idle gear 95 and an input shaft 97 are arranged independently of the shafts 17.

Figure 8A:
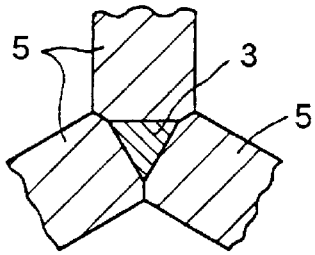
FIG. 8A is a partial sectional view showing the arrangement of work rolls which roll a wire having a regular triangular section with the rolling apparatus according to the first embodiment.
Figure 8B:
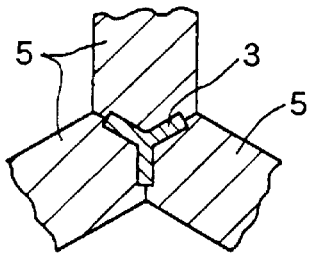
FIG. 8B is a partial sectional view showing the arrangement of work rolls which roll a wire having a substantially Y-shaped section with the rolling apparatus according to the first embodiment.
Figure 8C:
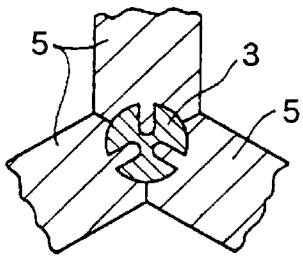
FIG. 8C is a partial sectional view showing the arrangement of work rolls which roll a wire having a circular section and grooves in three directions in its outer circumferential surface with the rolling apparatus according to the first embodiment.

FIGS. 8A to 8C are partial sectional views showing three examples of the sectional shape of the wire 3 which is rolled with the rolling apparatus according to the first embodiment. FIG. 8A shows an Fin arrangement which rolls a wire 3 having a regular triangular section, FIG. 8B shows an arrangement which rolls a wire 3 having a substantially Y-shaped section, and FIG. 8C shows an arrangement which rolls a wire 3 having a circular section and grooves in three directions in its outer circumferential surface.

Figure 9A:
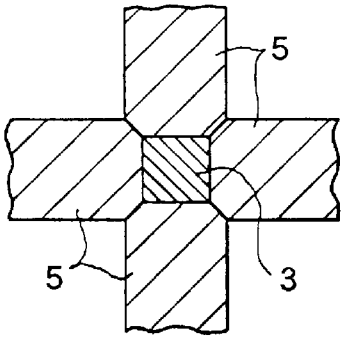
FIG. 9A is a partial sectional view showing the arrangement of work rolls which roll a wire having a square section with the rolling apparatus according to the second embodiment.
Figure 9B:
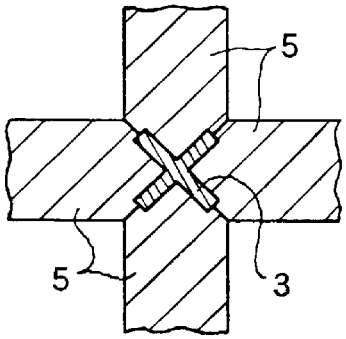
FIG. 9B is a partial sectional view showing the arrangement of work rolls which roll a wire having a substantially X-shaped section with the rolling apparatus according to the second embodiment.
Figure 9C:
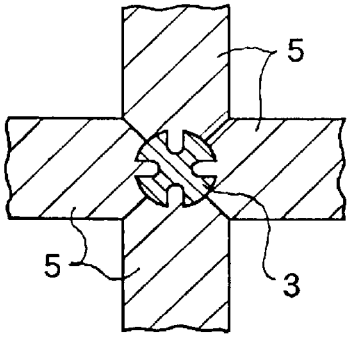
FIG. 9C is a partial sectional view showing the arrangement of work rolls which roll a wire having a circular section and grooves in four directions in its outer circumferential surface with the rolling apparatus according to the second embodiment.

FIGS. 9A to 9C are partial sectional views showing three examples of the sectional shape of the wire 3 which is rolled with the rolling apparatus according to the second embodiment. FIG. 9A shows an arrangement which rolls a wire 3 having a square section, FIG. 9B shows an arrangement which rolls a wire 3 having a substantially X-shaped section, and FIG. 9C shows an arrangement which rolls a wire 3 having a circular section and grooves in four directions in its outer circumferential surface.

Figure 10A:
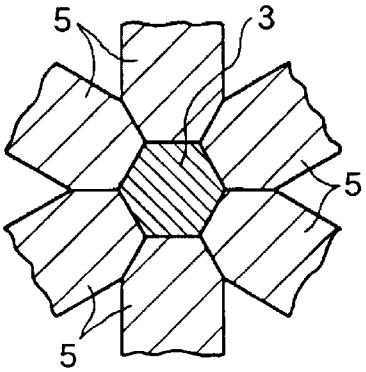
FIG. 10A is a partial sectional view showing the arrangement of work rolls which roll a wire having a regular hexagonal section with the rolling apparatus according to the third embodiment.
Figure 10B:
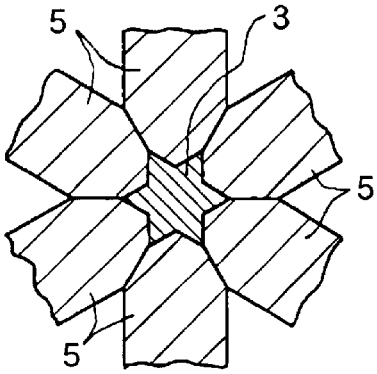
FIG. 10B is a partial sectional view showing the arrangement of work rolls which roll a wire having a section obtained by recessing the respective sides of a regular hexagonal shape with the rolling apparatus according to the third embodiment.
Figure 10C:
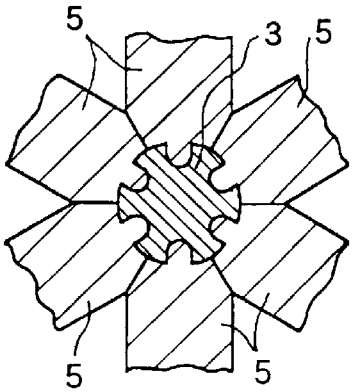
FIG. 10C is a partial sectional view showing the arrangement of work rolls which roll a wire having a circular section and grooves in six directions in its outer circumferential surface with the rolling apparatus according to the third embodiment.

FIGS. 10A to 10C are partial sectional views showing three examples of the sectional shape of the wire 3 which is rolled with the rolling apparatus according to the third embodiment. FIG. 10A shows an arrangement which rolls a wire 3 having a regular hexagonal section, FIG. 10B shows an arrangement which rolls a wire 3 having a section obtained by recessing the respective sides of a regular hexagonal shape, and FIG. 10C shows an arrangement which rolls a wire 3 having a circular section and grooves in six directions in its outer circumferential surface.

What is claimed is:

1. A wire rolling apparatus comprising:

a plurality of work rolls which form, at a portion where outer circumferential surfaces thereof abut against each other, a gap for rolling a wire, and which roll the wire while feeding the wire by rotation thereof;

a plurality of backup rolls arranged at positions substantially opposite to the gap with respect to said work rolls and pressed against said outer circumferential surfaces to transmit a drive force to said work rolls; and a rotating shaft for each backup roll, each of said work rolls having a rotation center offset from a rotation center of a corresponding one of said backup rolls in a feed direction, and further comprising a roll housing having a pair of first wall portions and a second wall portion, said pair of first wall portions being arranged to sandwich a corresponding one of said backup rolls along the rotating shaft thereof and supporting said rotating shaft, and said second wall portion being disposed in said feed direction and a direction opposite thereto relative to said backup roll and connecting said pair of first wall portion;

wherein said pair of first wall portions has bearing mechanisms that adjustably position said backup roll in the direction of said rotating shaft of said backup roll.

2. An apparatus as claimed in claim 1, further comprising a roll holder which holds said plurality of work rolls and is movable in said feed direction and the direction opposite thereto.

3. An apparatus as claimed in claim 1, wherein said roll housing is constituted by a pair of frames serially arranged in said feed direction.

* * * * *